United States Patent [19]

Lemonnier de Gouville et al.

[11] Patent Number: 4,690,636

[45] Date of Patent: Sep. 1, 1987

[54] FLAT TYPE GAS BURNER, MORE PARTICULARLY FOR HOUSEHOLD APPLIANCES, ADAPTED FOR USING DIFFERENT GASES

[75] Inventors: Jean B. Lemonnier de Gouville; Bernard Dane, both of Veigne, France

[73] Assignee: Sourdillon-Airindex, France

[21] Appl. No.: 817,727

[22] Filed: Jan. 10, 1986

[30] Foreign Application Priority Data

Jan. 30, 1985 [FR] France ..... 85 01311

[51] Int. Cl.[4] ..... F23D 14/62

[52] U.S. Cl. ..... 431/354; 126/39 E; 48/180.1

[58] Field of Search ..... 126/39 E, 39 K, 39 R, 126/39 M, 214 B, 39 H, 214 D, 214 R; 431/354, 355, 347; 48/180.1; 239/390, 396

[56] References Cited

U.S. PATENT DOCUMENTS

| | | | |
|---|---|---|---|
| 3,825,404 | 7/1974 | de Gouville | 431/354 |
| 4,165,963 | 8/1979 | Nozaki | 431/354 |
| 4,565,523 | 1/1986 | Berkelder | 126/39 E X |

*Primary Examiner*—Randall L. Green

*Attorney, Agent, or Firm*—Larson and Taylor

[57] ABSTRACT

A flat burner is provided, for household appliances, having a burner body (2) with an axial gas delivery passage (4) housing a gas injector and with a cap (8) resting on the body (2) through an annular ring (9) having flame orifices (12), an annular transversal convergent-divergent system being defined by the annular surface (11) of the body (2) bordering the passage (4) and the opposite surface (10) of the cap, in which: the diameter ($D_E$) of the passage (4) is $D_E = D_c \cdot K_3$ with $K_3 = 1.10$ to 1.43 and $D_c$ = the diameter equivalent to that of the venturi of the convergent-divergent $D_c = D_i \cdot K_4$ with $K_4 = 12.5$ to 22 and $D_i$ = diameter of the injector for butane gas; the angle ($\alpha$) of the convergent-divergent system is between 3° and 8°); the length of the divergent system is $$L_D = \frac{D_1 - D_2}{2} - (L_E + L_c),$$

with $D_1$ the outer diameter of the ring; and mechanical means are provided for setting the diameter $D_c$ as a function of the gas used.

7 Claims, 7 Drawing Figures

FLAT TYPE GAS BURNER, MORE PARTICULARLY FOR HOUSEHOLD APPLIANCES, ADAPTED FOR USING DIFFERENT GASES

The present invention relates to improvements to flat type burners, more especially for household appliances comprising a burner body with an axial, vertical and cylindrical gas inlet passage housing a gas injector, and a cap covering the burner body and resting thereon through an annular ring having circumferentially distributed flame orifices, the annular surface of the burner body skirting the opening of the gas mixture intake passage and the opposite surface of the cap having a truncated cone shape for defining an annular convergent-divergent system extending approximately transversely to the gas jet, the burner body and the annular ring further defining, between their opposite faces, an annular decompression chamber situated between said convergent divergent system and the flame orifices.

Gas burners, in particular those used in household appliances, are equipped with an injector followed by a convergent-divergent system (venturi) which, traditionally, is of the tubular type and is disposed in a duct carrying gas to the burner. Such an arrangement proves to be relatively cumbersome not only vertically but also horizontally.

To overcome this drawback, it has already been proposed to transfer the convergent-divergent device to the inside of the burner properly speaking and to adapt the burner so that the divergent means which it comprises is situated transversely to the gas jet coming from the injector, and in particular transversely about the axis of this jet. More particularly, in a burner comprising a cap for a ring flame, the divergent means is formed in the cap and is defined by conical facing surfaces formed in the cap and in the body, supporting this latter, through which the injected gas mixture arrives.

Such burners, already known, have however the drawback of only being able to be used with a single type of gas, under the conditions laid down by the standards.

The object of the invention is essentially to improve the flat type burners of this type so that they are capable of operating with all types of gas currently used in the household (gas of the first family called town gas; gas of the second family called natural gas; gas of the third family called liquid gas; substitution gas called butane air or propane air gas).

Figure 3:
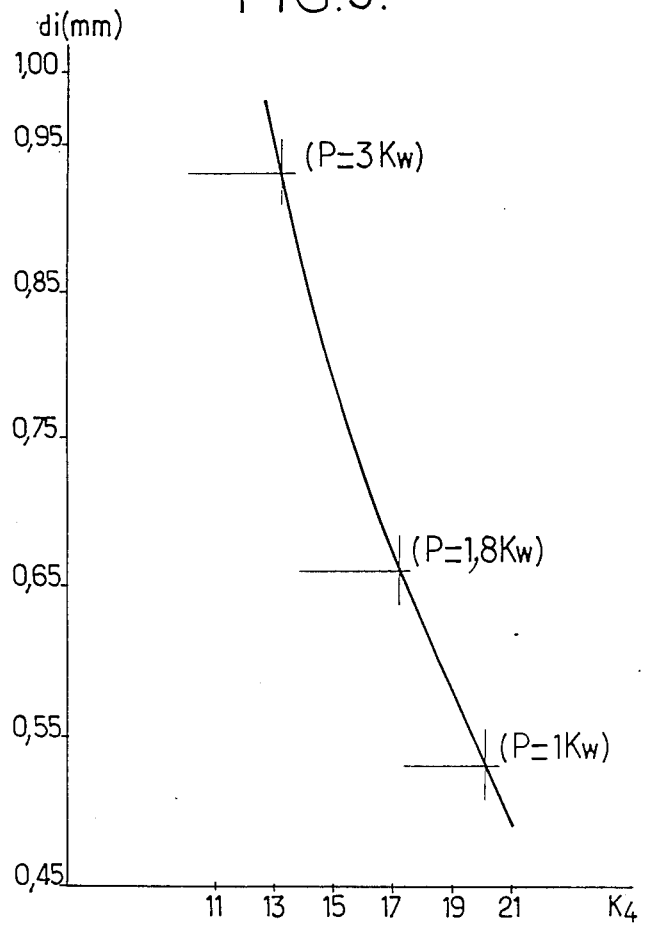
Figure 4:
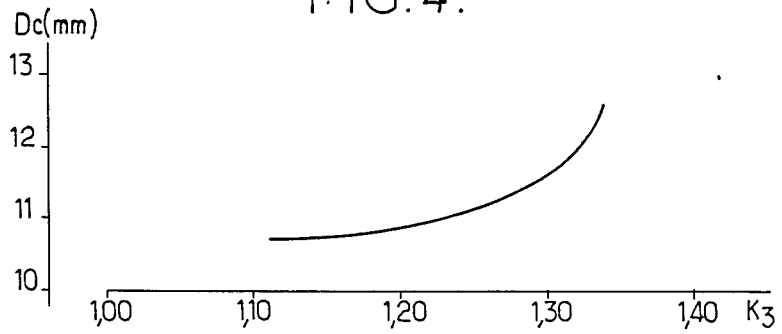

For this, a flat type burner adapted in accordance with the invention is characterized in that:

(a) the diameter ($D_E$) of the intake passage for the gas mixture is determined by:

$$D_E = D_c \cdot K_3$$

where $K_3$ is a coefficient substantially between 1.10 and 1.34 (respectively for burner powers greater than 0.6 kw) and determined for each value of Dc by the chart of FIG. 4, and $D_c$ is the diameter equivalent to the diameter of the venturi of the annular convergent-divergent system, determined by $D_c = D_i \cdot K_4$ with $D_i$=diameter (in mm) of the injector for butane gas, and $K_4$=coefficient substantially between about 12.5 and 22 determined for each value of $D_i$ by the charge shown in FIG. 3, (b) angle ($\alpha$) formed by the facing truncated cone shaped surfaces (10, 11) defining the annular convergent-divergent system is between about 3° and 8°, (c) the length ($L_D$) of the divergent portion is determined by $$L_D = \frac{D_1 - D_E}{1^2} - (1_E + 1_c)$$

in which $D_1$=outer diameter of the ring $1_E$=thickness of the ring $1_c$=thickness of the expansion chamber, (d) and mechanical means for adjusting, for each type of gas usable in the burner, the equivalent of the diameter of the venturi $D_c$ of the annular convergent-divergent system.

In a preferred embodiment, the height h of the annular constriction of the annular convergent-divergent system is about 2.3 mm and, advantageously the angle ($\alpha$) between the truncated cone shaped surfaces defining the convergent-divergent system is about 6°.

For facilitating the flow of the inflammable mixture, it is desirable for the annular convergent-divergent system to be situated approximately at the level of the flame orifices.

In a particularly interesting embodiment because of the simplicity of adapting the equivalent of the diameter of the venturi $D_c$ to the type of gas used, the above mentioned mechanical adjustment means comprise an adjusting ring in the form of a tubular sleeve which is engaged in the axial gas intake passage of the burner and which is adapted so as to be able to have different diameters. In this case, the manufacture of the component parts and the adjustment procedure may be further simplified, if the tubular sleeve is provided with longitudinal slits defining longitudinal tongues resiliently movable in the radial direction, if each tongue comprises a boss on its external face and if the internal face of the axial gas passage has longitudinal grooves defining radially stepped bearing surfaces for said respective bosses, each step of the bearing surfaces being associated with a type of gas usable by the burner.

For simple mounting not requiring any additional fixing pieces, the axial gas intake passage has a narrowed portion towards the bottom of the burner body, and this narrowed portion is adapted for receiving the gas injector; the tubular sleeve, with an axially pierced bottom, is placed between the injector and the burner body and is held in position by the injector which then serves simultaneously as fixing means.

With the arrangements used in accordance with the invention, a flat burner is obtained which may be adapted for each type of gas usable in household appliances. Adaptation is simple and quick to carry out and the burner keeps in all cases the same component parts.

Figure 1:
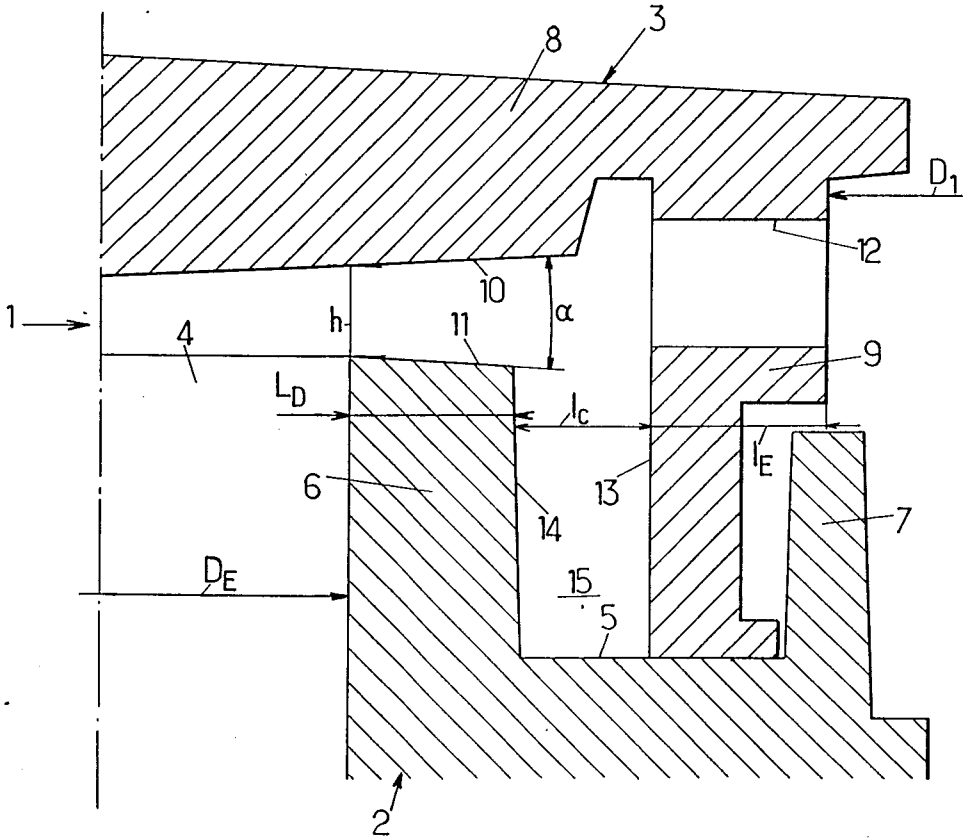
Figure 2A:
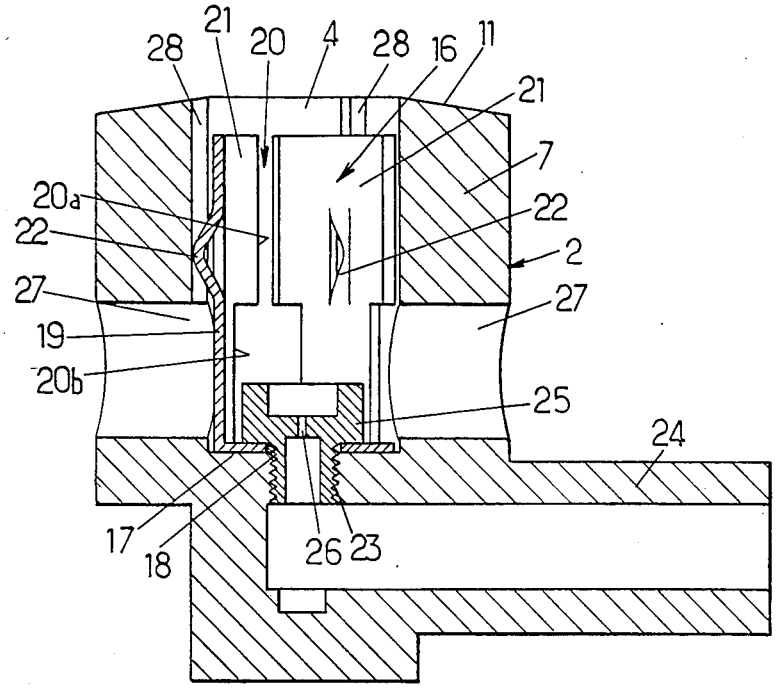
Figure 2B:
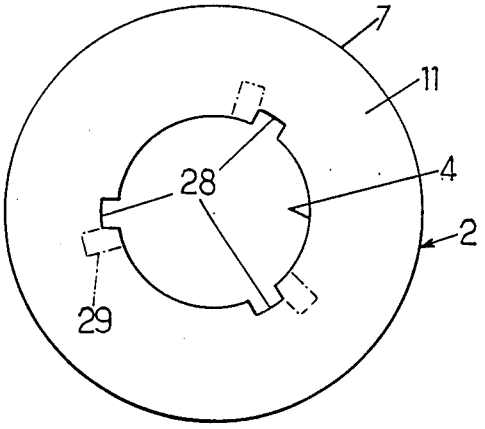

The invention will be better understood from reading the following detailed description of a preferred embodiment given solely by way of non limitative example. In this description reference is made to the accompanying drawings in which:

FIG. 1 is a schematical half view, from the base, in diametrical section of the upper part of a flat type burner adapted in accordance with the invention;

FIG. 2*a* is a schematical partial view, in diametrical section, of the body of the burner of FIG. 1 showing the arrangement for adapting to the type of gas used;

FIG. 2*b* is a top view of the burner body of FIG. 2*a;* and

FIGS. 3 to 6 show different curves illustrating relationships existing between different parameters characteristic of the burners of the invention.

Referring first of all to FIG. 1, a burner 1 adapted in accordance with the invention comprises essentially, in its upper part, a burner body 2 supporting a cover 3.

The burner body 2 has a vertical axial passage 4 passing therethrough, of a diameter $D_E$ for feeding the inflammable air-gas mixture.

The burner body 2 further has an annular plate 5 which is situated outwardly in the vicinity of the upper end of passage 4, and which is bounded inwardly by wall 6 defining said passage 4 (the thickness $L_D$ of wall 6 will be explained further on) and outwardly by an annular flange 7.

Cover 3 may, as shown, be a single piece combining a cap 8 extending above the burner body 2 and a ring 9 extending annularly in the vicinity of the peripheral edge of the cap. Cover 3 rests, through the foot of ring 9, on the plate 5 of the burner body, the height of the ring being such that the lower face of the cap is held at a distance from the burner body.

More precisely, the lower face 10 of the cap has a truncated cone shape and the opposite face 11 of the burner body (i.e. the annular edge of wall 6) also has a shape of a truncated cone and is slanted substantially symmetrically with face 10 with respect to a plane perpendicular to the axis of the passage 4.

Faces 10 and 11 opposite each other define an annular convergent-divergent system extending substantially perpendicularly to the jet of inflammable mixture leaving passage 4. This convergent-divergent system has a length $L_D$ (corresponding in this case to the above mentioned thickness of wall 6): the annular constriction (situated in line with the cylindrical face of passage 4) has a height h; the faces 10 and 11 form therebetween an angle $\alpha$.

Ring 9 has circumferentially spaced openings 12 (flame passage) situated approximately at the level of the convergent-divergent system.

Figure 5:
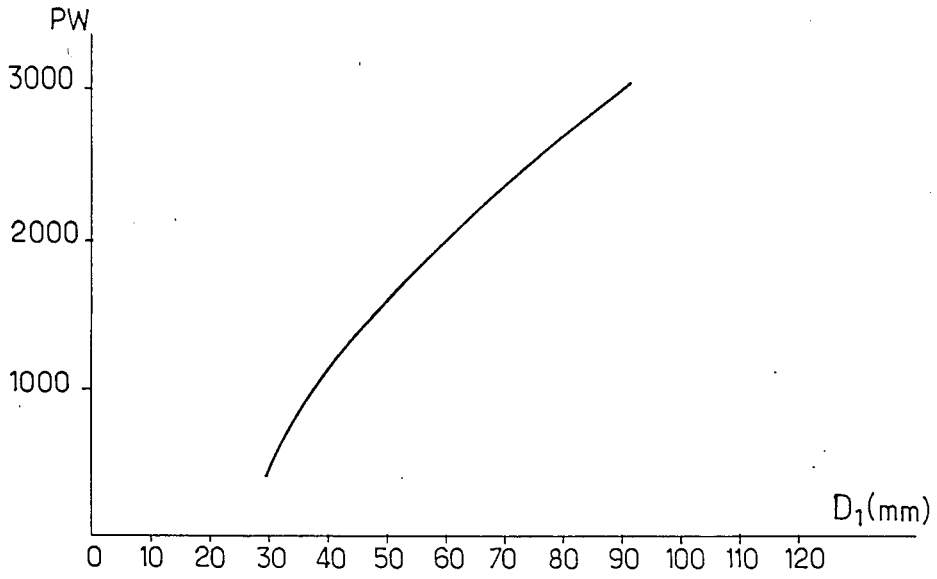

The ring has an external diameter $D_1$ which complies with the usual criteria known by a man skilled in the art, that is to say that it is determined as a function of the power of the burner so that this latter operates with given efficiency. FIG. 5 shows a curve giving the value of diameter $D_1$ in mm (plotted as abscissa) as a function of the power P in watts of the burner (shown as ordinates) for values of P the most usually used in practice (i.e. from about 600 watts to about 3000 watts). The most currently used values are:

$D_1=90$ mm for $P=3$ kw $D_1=55$ mm for $P=1.8$ kw $D_1=38$ mm for $P=1$ kw

The ring has a thickness $l_E$; its internal face 13 is situated at a distance $l_c$ from the opposite face 14 of wall 6: in other words, the faces 13 and 14 define an annular chamber 15 for decompression of the gas.

For the annular convergent-divergent system defined by surfaces 10 and 11, the equivalent of the diameter of the venturi $D_c$ is such that:

$$D_c=D_i \cdot K_4$$

where $D_i$ is the diameter (expressed in millimeters) of the calibrated passage of the injector provided for the use of butane gas, this diameter being determined in any appropriate way known by a man skilled in the art, and $K_4$ is a coefficient which may be determined, for each value of $D_i$, from the chart shown in FIG. 3 in which the values of $D_i$ (in millimeters) are plotted as ordinates and the values of $K_4$ are plotted as abscissa.

It can be seen that, for injectors having diameters varying from 1 to 0.45 mm (corresponding to powers between approximately 4 kw and 0.6 kw respectively), the corresponding values of $K_4$ vary from 12.5 to 22 respectively.

The diameter $D_E$ of the inflammable mixture delivery passage 4 is such that:

$$D_E=D_C \cdot K_3$$

where $K_3$ is a coefficient which may be determined, for each value of $D_c$, from the chart shown in FIG. 4 in which the values of $D_c$ (in millimeters) are plotted as ordinates and the values of $K_3$ are plotted as abscissa.

It can be seen that, for a fictitious venturi diameter $D_C$ of about 10.7 mn, corresponding to a power of 0.6 kw, the value of $K_3$ is about 1.10 and that, for a diameter $D_c$ of at least 13 mm, corresponding to a power of at least 4 kg, the value of $K_3$ is about 1.34.

The length $L_3$ of the divergent system is:

$$L_D = \frac{D_1 - D_E}{2} - (l_E + l_c)$$

Figure 6:
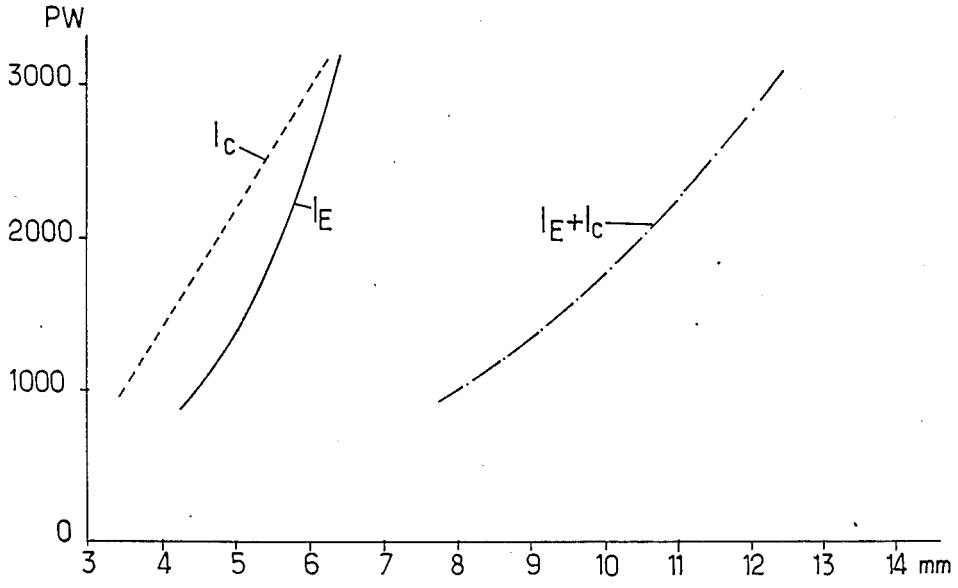

The values $l_E$ and $l_c$ are determined for example from the chart given in FIG. 6 showing the values of $l_E$, $l_c$ and $l_E+l_c$ plotted as abscissa (expressed in millimeters) as a function of the power of the burner plotted as ordinates (expressed in watts).

So that the convergent-divergent system has maximum efficiency, the angle $\alpha$ is between about 3° and 8°, preferably equal to 6°.

Finally, the height h of the annular constriction of the convergent-divergent system is about 2.3 mm with a tolerance of ±10%.

The adaptation of the above mentioned equivalent diameter $D_c$ for each type of gas usable in the burner of the invention is obtained by using mechanical adjustment means which, as shown in FIGS. 2*a* and 2*b*, are formed by a single member or adjustment ring.

In the embodiment chosen for its simplicity of manufacture, assembly and operation, the adjustment ring 16 is in the form of a tubular sleeve having a bottom 17 pierced with an axial orifice 18. The side wall 19 of ring 16 is split longitudinally over the whole of its length or over substantially the whole of its length; three slits 20 may for example be provided defining therebetween three tongues 21. Slits 20 are shaped so as to have a first relatively narrow part 20*a* (considered from the upper edge of the ring) followed, towards the base of the ring, by a widened portion 20*b* having a substantially greater width (for example 2 or 3 times the width of part 20*a*).

In addition, each tongue 19 has an outwardly projecting boss 22 situated, for example, at about a third of the way from the top of tongue 19. Advantageously, boss 22 is formed by a longitudinal strip cut out and pressed outwardly.

Ring 16 is made from metal, for example from steel, and tongues 19 are resiliently movable in the radial direction.

As shown in FIG. 2*a*, the burner body 2 has, as already mentioned, an axial vertical passage 4 surrounded by an annular wall 7. At the base of passage 4 is provided a threaded bore 23 opening into a horizontal gas delivery duct 24 intended to be connected to a supply pipe (not shown).

In bore 23 is screwed a gas injector 25 having a calibrated orifice 26. As shown in FIG. 2*a*, the bottom 17 of the adjustment ring 16 is gripped between the bottom of passage 4 and injector 25 which thus plays the auxiliary role of bolt fixing the adjustment ring.

Air passage orifices 27 are pierced in wall 7, at the base thereof, substantially at the level of the widened portions 20*a* of slits 20 of ring 16.

Finally, as can be seen in FIGS. 2*a* and 2*b*, longitudinal rectilinear grooves 28 are formed in the face of wall 7 defining passage 4. These grooves 28 are in number equal to that of bosses 22, have the same mutual angular spacing as the bosses and are dimensioned, in width and in depth, so as to be able to receive the bosses 22 without the tongues 21 being nipped radially (as shown in FIG. 2*a*). The ring may also be fitted in passage 4 while being rotated slightly angularly with respect to the position shown in FIG. 2*a*; the bosses 22 then bear against the face defining passage 4, so that the tongues are brought radially slightly back towards the inside.

The result is that, in this latter case, the section is substantially more reduced than in the first case. It is thus possible, with the arrangements of the invention, to adapt the equivalent diameter $D_c$ of the venturi by simply rotating ring 16 about its axis.

In the embodiment shown in FIGS. 2*a* and 2*b*, the number of angular positions of ring 16 has been limited to two, for that is sufficient in practice for the different types of gas usually used in the household.

The first position of the ring shown (see FIG. 2*a*) corresponds to the use of a gas of GPL type (more particularly butane, propane), whereas the second position corresponds to the use of gas of the natural gas type or manufactured type (town gas, butane charged air, propane charged air).

Of course, if it proved necessary, it would be quite possible to provide other angular positions of ring 16, corresponding to a different nipping of tongues 21 and so to a different equivalent diameter $D_c$; for this for example bearing zones 29 may be provided of an even larger radius (by adopting bosses 22 having a projection of appropriate size) as shown with broken lines in FIG. 2*b*. The grooves 28 then have a stepped profile in cross section.

It will be noted that, although the power range 1 kW–3 kW is the most widely used for gas cookers currently commercialized, the arrangements of the invention remain applicable for designing flat type gas burners in a power range going from 0.6 kW to 4 kW and even beyond (for example for restaurant cooker burners whose power may reach 6 of 7 kW).

As is evident and as it follows moreover already from what has gone before, the invention is in no wise limited to those of its modes of application and embodiments which have been more especially considered; it embraces; on the contrary, all variants thereof.

We claim:

1. A flat type burner, more particularly for household applicances, comprising a burner body (2) with an axial, vertical and cylindrical gas mixture delivery passage (4) housing a gas injector (25) and a cap (8) covering the burner body (2) and resting thereon through an annular ring (9) having circumferentially spaced flame orifices (12), the annular surface (11) of the burner body bordering the opening of the gas mixture delivery passage (4) and the opposite surface (10) of the cap (8) defining an annular convergent-divergent system extending approximately transversely to the axis of the gas delivery passage, the burner body (2) and the annular ring (9) further defining between their opposite faces an annular decompression chamber (15) situated between said convergent-divergent system and the flame orifices (12), characterized in that:

(a) the diameter ($D_E$) of the gas mixture delivery passage is determined by:

$$D_E = D_c \cdot K_3$$

where $K_3$ is a coefficient substantially between 1.10 and 1.34, (respectively for burner powers greater than 0.6 kW) determined for each value of $D_c$ by the chart shown in FIG. 4, and $D_c$ is the frustroconical diameter equivalent to the Venturi diameter of the said annular convergent-divergent system, determined by $$D_c = D_i \cdot K_4$$

with $D_i$=diameter (in mm) of the injector for butane gas and $K_4$=coefficient substantially between about 12.5 and 22 determined for each value of $D_i$ from the charge of FIG. 3, (b) an angle ($\alpha$) formed by the opposite truncated cone shaped surfaces (10, 11) defining the annular convergent-divergent system is between about 3° and 8°, (c) a length ($L_D$) of the divergent system is determined by:

$$L_D = \frac{D_1 - D_E}{2} - (l_E + l_c)$$

where $D_1$=outer diameter of the ring $l_E$=thickness of the ring $l_c$=thickness of the expansion chamber (d) and mechanical means (16) within the gas delivery passage for setting, for each type of gas usable in the burner, the venturi diameter equivalent ($D_c$) of the annular convergent-divergent system.

2. The burner according to claim 1, characterized in that the height (h) of the annular constriction of the annular convergent-divergent system is about 2.3 mm.

3. The burner according to claim 1, characterized in that the angle ($\alpha$) between the truncated cone shaped surfaces defining the convergent-divergent system is about 6°.

4. The burner according to claim 1, characterized in that the annular convergent-divergent system is situated approximately at the level of the flame orifices (12).

5. The burner according to claim 1, characterized in that the mechanical means (16) for setting the equivalent diameter ($D_c$) comprise an adjustment ring (16) in the form of a tubular sleeve which is engaged in the axial gas mixture delivery passage of the burner and which is adapted so as to be able to have different diameters.

6. The burner according to claim 5, characterized in that the tubular sleeve (6) is provided with longitudinal slits (20) defining longitudinal tongues (21) movable resiliently in the radial direction, in that each tongue (21) comprises a boss (22) on its external face, and in that the internal face of the axial passage (4) has longitudinal grooves (28) defining radially stepped bearing surfaces for said respective bosses (22), each step of the bearing surfaces being associated with a type of gas usable by the burner.

7. The burner according to claim 4, characterized in that the axial gas delivery passage (4) has a narrowed portion (23) towards the bottom of the burner body, in that this narrowed portion is adapted for receiving the gas injector (25) and in that the tubular sleeve (16), with a bottom (17) pierced axially (at 18), is interposed between the injector and the burner body and held in place by the injector which then serves simultaneously as fixing member.

* * * * *